US011492956B2

(12) United States Patent
Bertani

(10) Patent No.: US 11,492,956 B2
(45) Date of Patent: Nov. 8, 2022

(54) TWO-STROKE INTERNAL COMBUSTION ENGINE

(71) Applicant: EMAK S.P.A., Bagnolo in Piano (IT)

(72) Inventor: Andrea Bertani, Reggio Emilia (IT)

(73) Assignee: EMAK S.P.A., Bagnolo in Piano (IT)

( * ) Notice: Subject to any disclaimer, the term of this patent is extended or adjusted under 35 U.S.C. 154(b) by 0 days.

(21) Appl. No.: 17/413,126

(22) PCT Filed: Dec. 3, 2019

(86) PCT No.: PCT/IB2019/060388
§ 371 (c)(1),
(2) Date: Jun. 11, 2021

(87) PCT Pub. No.: WO2020/136478
PCT Pub. Date: Jul. 2, 2020

(65) Prior Publication Data

US 2022/0065159 A1 Mar. 3, 2022

(30) Foreign Application Priority Data

Dec. 27, 2018 (IT) ..... 102018000021094

(51) Int. Cl.
*F02B 25/16* (2006.01)
*F02B 75/02* (2006.01)

(52) U.S. Cl.
CPC ..... *F02B 25/16* (2013.01); *F02B 75/02* (2013.01); *F02B 2075/025* (2013.01)

(58) Field of Classification Search
CPC ..... F02B 75/02; F02B 25/16; F02B 2075/025
See application file for complete search history.

(56) References Cited

U.S. PATENT DOCUMENTS 666,264 A * 1/1901 Denison ..... F01L 7/06 123/73 D
6,491,006 B2 * 12/2002 Jonsson ..... F02B 63/02 123/73 R
6,513,466 B2 * 2/2003 Bignion ..... F02B 63/02 123/73 V
2004/0040522 A1 3/2004 Mavinahally et al.

FOREIGN PATENT DOCUMENTS

GB 2563685 A 12/2018
WO 9212332 A1 7/1992

* cited by examiner

*Primary Examiner* — Kevin A Lathers
(74) *Attorney, Agent, or Firm* — Volpe Koenig

(57) ABSTRACT

A two-stroke internal combustion engine includes:—a base;—a head, fixed to the base, and having a cylindrical cavity;—a piston slidable in the cylindrical cavity, to define a combustion chamber and a pumping chamber, and movable in the cylindrical cavity between a bottom and a top dead center;—a transfer duct having an inlet mouth in fluid communication with the pumping chamber, and an outlet mouth in fluid communication with the combustion chamber;—an exhaust duct having an inlet mouth in fluid communication with the combustion chamber,—a crank shaft partially housed in the pumping chamber;—a connecting rod connecting the piston to the crank shaft;—a movable partition housed inside the pumping chamber operatively connected to the crank shaft to occlude the transfer duct inlet mouth and to put in fluid communication the transfer duct inlet mouth with the pumping chamber.

5 Claims, 7 Drawing Sheets

TWO-STROKE INTERNAL COMBUSTION ENGINE

TECHNICAL FIELD

The present invention relates in general to a two-stroke internal combustion engine. More particularly, the present invention relates to a two-stroke internal combustion engine of medium-small size, adapted to be installed on portable working tools, such as gardening tools such as brush cutters, lawn mowers, chain saws and the like.

PRIOR ART

Two-stroke internal combustion engines generally comprise a base in which a crank chamber is obtained, i.e. a chamber adapted to contain the crank shaft of the engine, and a head fixed above the base.

Inside the head of the engine there is obtained at least a straight cylinder that in the lower part flows into the crank chamber.

Inside the cylinder, a piston is free to slide, which separates a combustion chamber, defined inside the cylinder, from a pumping chamber, defined inside the crank chamber.

The piston is connected to the crank shaft through a connecting rod and is movable between a bottom dead center, in which the volume of the combustion chamber is maximum and the volume of the pumping chamber is minimum, and a top dead center, in which the volume of the combustion chamber is minimum and the volume of the pumping chamber is maximum.

In the head or in the base a suction duct is generally formed whereby a fresh charge of fuel mixture charge enters the engine, specifically the pumping chamber, through an outlet mouth of the suction duct itself.

From the pumping chamber the fresh charge can reach the combustion chamber by means of a transfer duct, formed in the head, which has an inlet mouth which flows directly into the pumping chamber and an outlet mouth which flows directly into the combustion chamber.

The engine is also equipped with an exhaust duct, obtained in the head of the engine, which allows the evacuation of the combustion products and has an inlet directly communicating with the combustion chamber.

Medium and small two-stroke engines are powered by a charge consisting of a mixture of gasoline and oil which is reduced to small drops and mixed with air by a supply system, for example comprising a carburetor.

The two-stroke engines perform an entire combustion cycle of said mixture during a single 360° rotation of the crank shaft.

This cycle provides that when the piston is at the top dead center, the outlet mouth of the suction duct is open and fresh charge enters the pumping chamber, while the outlet mouth of the transfer duct and the inlet mouth of the exhaust duct are closed.

As the piston is at the top dead center, the combustion of the fresh charge is in progress and the gases, expanding, push the piston towards the bottom dead point which, in its downward stroke, first opens the inlet mouth of the exhaust duct and then opens the outlet mouth of the transfer duct, while simultaneously closing the outlet mouth of the suction duct.

In this step, known as the washing step, the exhaust gases escape from the exhaust duct while the mixture present in the pumping chamber reaches the combustion chamber through the transfer ducts.

Once the bottom dead center has been reached, the piston returns to the top dead center, ejecting the burnt gases and compressing the mixture into the combustion chamber and closing the outlet mouth of the transfer duct first and then the inlet mouth of the exhaust duct.

A known problem is that during the washing step, due to the intrinsic conformation of the two-stroke engine whereby there is a complete overlap between the period of time in which the outlet mouth of the transfer duct is placed in communication with the combustion chamber and the period of time in which the inlet mouth of the exhaust duct is placed in communication with the expansion chamber, part of the fresh charge pumped by the cylinder into the expansion chamber through the transfer duct is directly ejected through the exhaust duct. Consequently during this step, the two-stroke engine gives the environment a high quantity of gasoline and oil, which are pollutants dangerous for health. Moreover, this loss of fresh mixture in the exhaust duct causes a decrease in efficiency, therefore an increase in consumption, with respect to an ideal cycle in which all the fresh mixture remains in the cylinder following the washing step.

An expedient known to the man skilled in the art to reduce the degree of overlap between the outlet mouth of the transfer duct and the inlet mouth of the exhaust duct is to reduce the passage section of the outlet mouth of the transfer duct. However, this solution is penalizing from the point of view of efficiency, understood as the ratio between the energy generated and the mechanical losses, because it causes an increase in the load losses suffered by the fresh mixture in passing through the transfer duct and consequently an increase in the energy absorbed by the piston to pump the fresh mixture from the pumping chamber to the combustion chamber through the transfer ducts.

An object of the present invention is therefore to reduce the amount of fresh mixture which is ejected during the washing step in order to decrease the environmental impact of the engine and increase the efficiency, that is, reduce consumption and exceed the limitations of the prior art.

Such objects are achieved by the features of the invention disclosed in the independent claim. The dependent claims describe preferred and/or particularly advantageous aspects of the invention.

DISCLOSURE OF THE INVENTION

The invention provides a two-stroke internal combustion engine comprising:

- a base
- a head fixed to the base and in which a cylindrical cavity is formed,
- a piston slidably received in the cylindrical cavity, so as to define a combustion chamber and a pumping chamber, and movable in the cylindrical cavity between a bottom dead center, in which the volume of the combustion chamber is maximum and the volume of the pumping chamber is minimum, and a top dead center, in which the volume of the combustion chamber is minimum and the volume of the pumping chamber is maximum,
- a transfer duct provided with an inlet mouth adapted to be placed in fluid communication with the pumping chamber, and with an outlet mouth adapted to be placed in fluid communication with the combustion chamber,
- an exhaust duct provided with an inlet mouth adapted to be placed in fluid communication with the combustion chamber, a crank shaft at least partially housed in the pumping chamber, a connecting rod adapted to connect the piston to said crank shaft, wherein the two-stroke internal combustion engine implements, by means of the movement of the piston between the top dead center and the bottom dead center, an operating step during which the inlet mouth of the exhaust duct and the outlet mouth of the transfer duct are simultaneously in fluid communication with the pumping chamber, said internal combustion engine being characterized in that it comprises a movable partition housed inside the pumping chamber and operatively connected to the crank shaft to occlude the inlet mouth of the transfer duct during a first portion of said operating step, and to put in fluid communication the inlet mouth of the transfer duct with the pumping chamber during a second portion of the operating step.

Thanks to this solution it is possible to reduce consumption and improve the environmental impact of the engine, even without significantly affecting the performance thereof. This is because through the partition, it is prevented that, in the first opening step of the outlet mouth of the transfer duct, the pressure obtained in the cylinder downstream of the first spontaneous exhaust step may recall fresh mixture through the transfer duct and because the obstruction of the inlet port of the transfer duct in a step in which the piston is reducing the size of the pumping chamber allows generating an overpressure in the pumping chamber, greater than in a two-stroke engine not provided with the movable partition, which allows the mixture to be brought into the pumping chamber in a short time and with a greater pressure than an engine not provided with the movable partition.

One aspect of the present invention provides that the end of the first portion of the operating step may be between 30° of rotation of the crank shaft before the bottom dead center and 30° of rotation of the crank shaft after the bottom dead center.

In this way an optimal compromise can be achieved, between preventing the discharge of fresh charge in the exhaust, which serves to reduce the polluting emissions, and to have sufficient time available to introduce the fresh charge into the combustion chamber. According to another aspect of the invention, the second portion of the operating step may continue until the end of the operating step itself.

In this way, an optimal inlet of the fresh mixture is guaranteed.

According to another aspect of the invention, the movable partition may be fixed to the crank shaft and rotated thereby with respect to a rotation axis of the crank shaft itself. In this way, the method of operating the partition is particularly robust and ensures effective synchronization with the rotation of the crank shaft.

For example, the movable partition may comprise:

a disc-shaped body, which is rigidly integral in rotation to the crank shaft and is positioned so as to occlude the inlet mouth of the transfer duct at least during the first portion of the operating step, and a through slot formed in the disc-shaped body and positioned in such a way as to place in fluid communication the inlet mouth of the transfer duct with the pumping chamber during the second portion of the operating step.

Thanks to this solution, the partition is robust and reliable and easy to implement even on two-stroke engines designed to work without the partition. It also allows an efficient insulation between the pumping chamber and the transfer duct, reducing leakage to a minimum.

Another aspect of the invention provides that the movable partition may comprise an annular sealing body extending from the radial periphery of the disc-shaped body in the opposite direction to the inlet mouth of the transfer duct.

In this way, it is possible to further reduce the leakage between the pumping chamber and the transfer duct.

A further aspect of the invention provides that the movable partition may comprise a further through slot formed in the disc-shaped body, in a portion of the same disc-shaped body proximal to the crank shaft.

This ensures proper lubrication of the crank shaft journal bearings despite the presence of the disc-shaped body between said bearing and the pumping chamber.

Possibly, the movable partition may be implemented as a single body with the crank shaft.

Thanks to this solution it is possible to simplify and speed up the assembly of the engine, without the crank shaft implementation step increasing.

Furthermore, the disc-shaped body may be interposed between a crank shaft and the base.

This solution ensures a high compactness of the engine.

BRIEF DESCRIPTION OF THE FIGURES

Further features and advantages of the invention will become apparent from the following description, provided by way of non-limiting example with the aid of the figures shown in the accompanying drawings.

DETAILED DESCRIPTION

Figure 1:
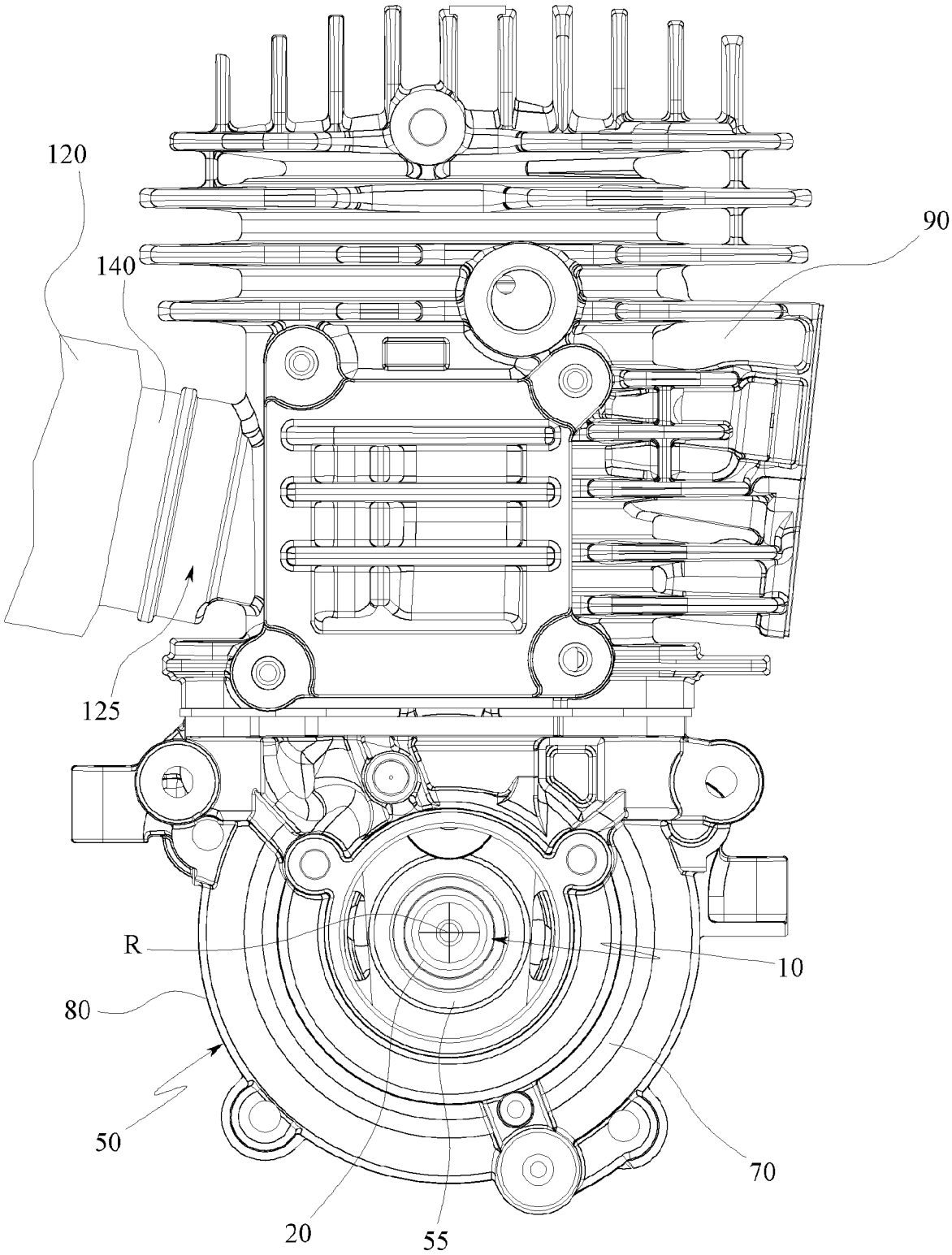
FIG. 1 is a lateral view of yet another embodiment of the device according to the invention.
Figure 2:
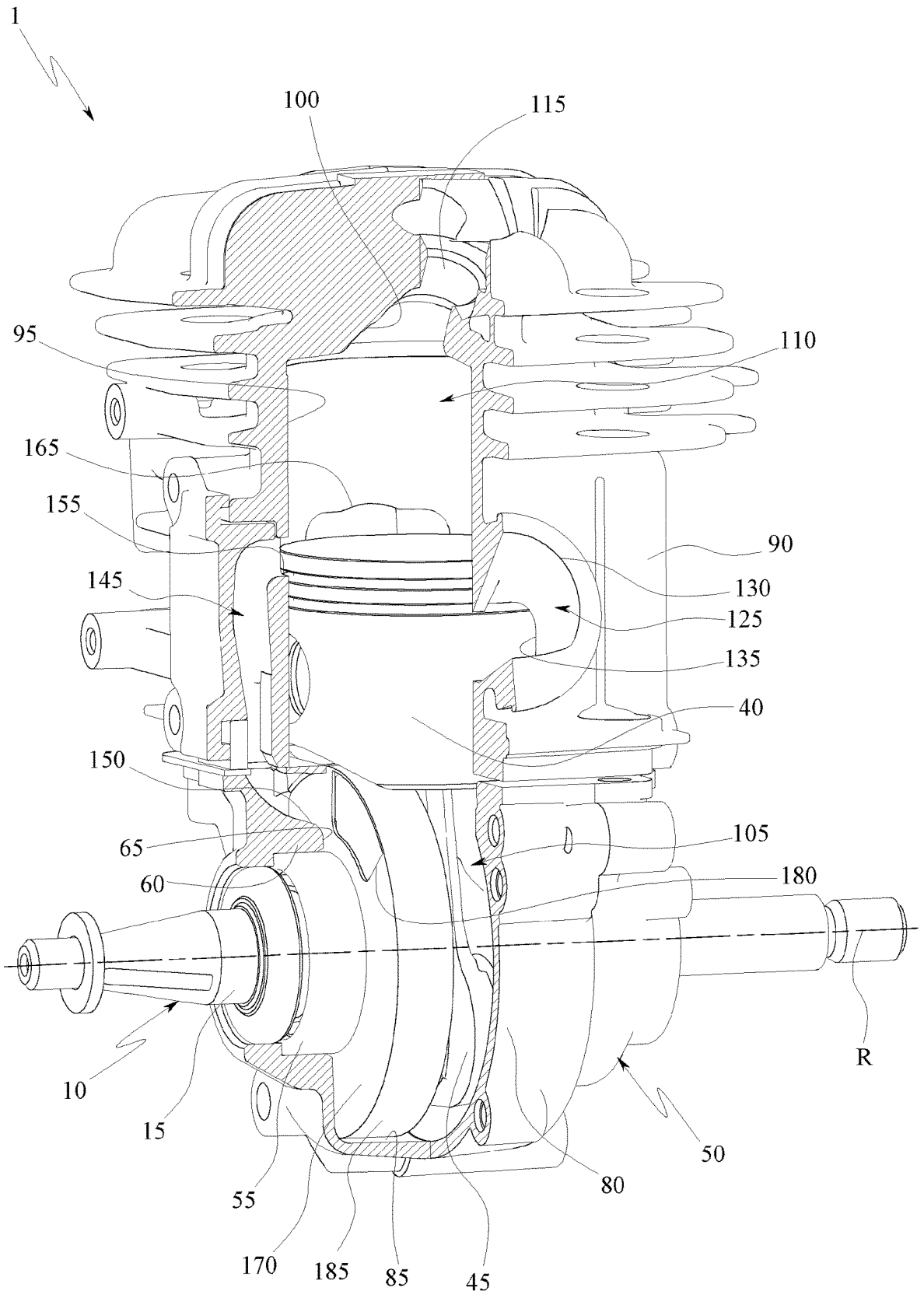
FIG. 2 is an axonometric view in partial section on two planes perpendicular to one another of the two-stroke internal combustion engine in FIG. 1, such a view of FIG. 2 shows a movable partition according to the invention, said movable partition being shown not sectioned in this figure. Moreover, in FIG. 2, a piston of the engine is in a step in which a bottom dead center is moving towards a top dead center and does not yet occlude an outlet mouth of a transfer duct.
Figure 3:
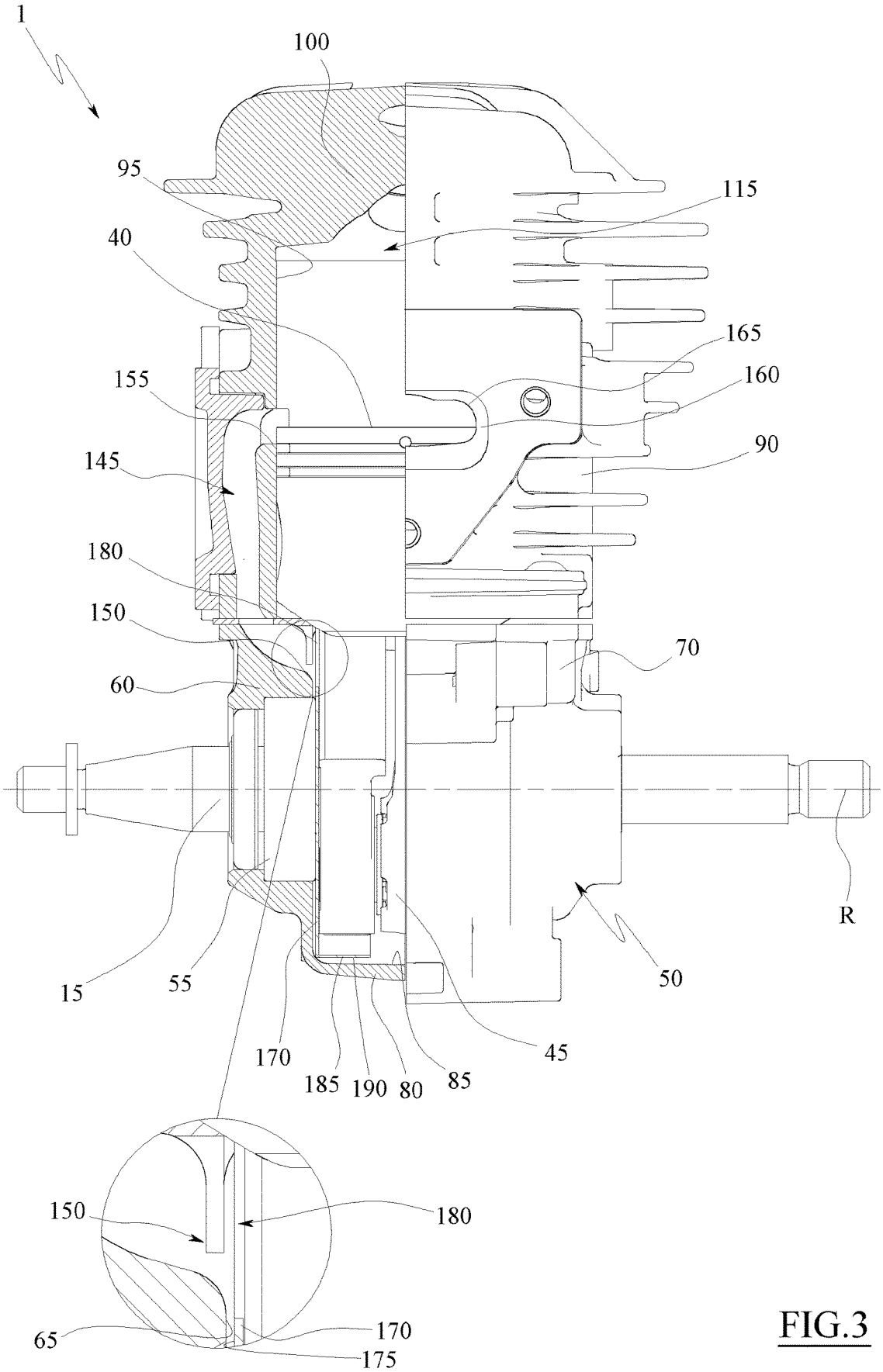
FIG. 3 is a front view of the section in FIG. 2, in which the movable partition is shown as sectioned.

With particular reference to such figures, reference numeral 1 globally indicates a two-stroke internal combustion engine, which can be fed by a gaseous mixture composed of air, fuel and lubricating fluid.

To promote compactness and clarity of reading, the two-stroke internal combustion engine 1 will be referred to as engine 1 hereinafter.

The engine 1 comprises a crank shaft 10 adapted to rotate with respect to a rotation axis R and through which the driving force generated by the engine itself is removed.

It should be noted that crank shaft means a shaft integrating a crank, which has an end portion crossed by the shaft rotation axis and an opposed end portion distal from said rotation axis.

The crank shaft 10 may comprise a first cylindrical section 15 coaxial to the rotation axis R, a second cylindrical section 20 opposed to the first cylindrical section 15 and coaxial to the rotation axis R, and a crank 25 which connects the first cylindrical section 15 and the second cylindrical section 20 and is rigidly integral in rotation thereto (without residual degrees of freedom).

Said crank extends from the first cylindrical section 15 and from the second cylindrical section 20, for example from proximal ends of said cylindrical portions, in a radial direction away from the rotation axis R.

The crank 25 comprises a pin 30 located at an end portion of the crank itself distal from the rotation axis R. Such a pin has a central axis parallel and eccentric with respect to the rotation axis R.

In the illustrated embodiment, the crank comprises two arms extending from the proximal ends of the cylindrical portions in the direction of displacement with respect to the rotation axis R and between which the pin 30 is interposed.

The crank shaft 10 comprises a flywheel mass 35 rigidly integral in rotation with the cylindrical sections. For example, such a flywheel mass 35 protrudes with respect to the first cylindrical section 15 and to the second cylindrical portion 20, preferably in a radial direction opposite to the crank 25.

In the illustrated embodiment, the flywheel mass 35 comprises a pair of disc sectors integral in rotation each to a respective portion of said cylindrical sections. The flywheel mass 35 and the crank 25 may for example be made as a single body, that is, as a single-piece body.

The engine 1 comprises a piston 40 associated with the crank shaft 10 by a connecting rod 45.

Said connecting rod 45 at one end is hinged to the piston 40, or to a pin (not illustrated) associated with the piston, and at the opposite end is hinged to the crank shaft 10, or to the pin 30 of the crank 25, for example by the interposition of a bearing.

The engine 1 comprises a base 50 provided with a seat for receiving the crank shaft 10, such a crank shaft 10 is rotatably associated with the crankcase with respect to the rotation axis R, for example by interposing a pair of bearings 55 each coupled to a respective section between the first cylindrical section 15 and the second cylindrical section 20.

The receiving seat comprises a first wall 60 transverse to the rotation axis R, for example perpendicular to the rotation axis R.

The first wall 60 is provided with an inner surface 65 facing the inside of the base, for example facing the crank 25.

Such an inner surface 65 of the first wall 60 is flat and lies on a plane perpendicular to the rotation axis R. Preferably it is also circular.

The first wall 60 is crossed by the first cylindrical section 15 of the crank shaft 10 and defines a seat for housing a bearing 55 of the pair of bearings 55.

The receiving seat also comprises a second wall 70, opposed to the first wall 60 and transverse to the rotation axis R, for example perpendicular to the rotation axis R.

The second wall 70 is provided with an inner surface (not shown in the drawings) facing the inside of the base, for example facing the crank 25.

Such an inner surface of the second wall 70 is flat and lies on a plane perpendicular to the rotation axis R. Preferably it is also circular.

The second wall 70 is crossed by the second cylindrical section 20 of the crank shaft 10 and defines a seat for housing the other bearing 55 of the pair of bearings 55.

The receiving seat comprises a side wall 80 which joins the first wall 60 and the second wall 70. For example, this side wall is provided with a curved surface 85 which extends between the first wall 60 and the second wall 70.

In the illustrated embodiment, the curved surface 85 of the side wall 80 is shaped as a side portion of a cylinder.

The engine 1 comprises a head 90, for example provided with fins for dissipating the heat, fixed above the base 50 and in which a cylindrical cavity 95 is obtained, which has an open end at the portion thereof facing the base while an opposite end is closed by a wall 100 of the head 90.

The cylindrical cavity 95 has a central axis orthogonal to the rotation axis R of the crank shaft 10.

Inside the cylindrical cavity 95 the piston 40 is slidably associated, defining a pumping chamber 105, defined by the union of the volume of the seat for receiving the crank shaft 10 with the volume of a portion of the cylindrical cavity 95 included between the piston 40 and said receiving seat, and a combustion chamber 110, defined by the volume of the cylindrical cavity portion included between the wall 100 and the piston 40.

The piston 40 is movable, by means of the connecting rod 45 and the crank shaft 10, within the cylindrical cavity 95 between a bottom dead center, in which the volume of the combustion chamber 110 is maximum and the volume of the pumping chamber 105 is minimum, and a top dead center, in which the volume of the combustion chamber 110 is minimum and that of the pumping chamber 105 is maximum.

The wall 100 of the head 90 provides a seat 115 configured to house a spark plug capable of igniting the combustion of the mixture present in the combustion chamber 110. The seat 115 may consist, for example, of a threaded through hole having a central axis parallel to the longitudinal axis of the cylinder.

The engine 1, with specific reference to FIG. 1, may comprise a feeding device 120, preferably only adapted to provide a mixture of fuel and air and to vary the amounts produced, for feeding said mixture to the pumping chamber.

For example, the feeding device 120 comprises a carburetor which is not further described as widely known to the man skilled in the art.

The engine 1 further comprises a suction duct 125, for example formed in the head 90, through which the mixture flow is directly introduced into the pumping chamber 105.

For example, the suction duct 125 is configured to enter the mixture flow with a transverse direction, for example substantially perpendicular, to the rotation axis R.

In particular, the suction duct 125 comprises an inlet mouth 130 and an outlet mouth 135, for example a single inlet mouth 130 and a single outlet mouth 135, such an outlet mouth 135 is adapted to be placed in fluid communication with the pumping chamber 105.

For example, the outlet mouth 135 is formed in a portion of the cylindrical cavity 95, preferably proximal to a portion of the side wall 80 of the base 50.

The suction duct 125 is internally empty.

That is, the suction duct 125 does not house therein any device adapted to regulate a flow of fluid, or mixture, coming from the feeding device and directed to the pumping chamber 105 which passes through the suction duct 125 and there are no devices configured to add or subtract fluid to said flow.

These regulating devices are generally laminar packs or rotating discs.

For example, the engine 1 comprises a suction manifold 140 directly interposed between the feeding device 120 and the suction duct 125, such a suction manifold 140 is internally empty and is traversed only by mixture or air.

That is, the intake manifold 140 does not house therein any device adapted to regulate a flow of fluid, or mixture, coming from the feeding device 120 and directed to the pumping chamber 105 which passes through the intake manifold 140 and there are no devices configured to add or subtract fluid to said flow.

Preferably, the carburetor of the feeding device 120 is directly connected to the intake manifold 140.

The engine 1 comprises a transfer duct 145, for example partially formed in the head 90 and partially in the base 50, and adapted to place the pumping chamber 105 and the combustion chamber 110 in fluid communication, since it is provided with an inlet mouth 150 adapted to be placed in fluid communication with the pumping chamber 105 and an outlet mouth 155 adapted to be placed in fluid communication with the combustion chamber 110.

In the illustrated embodiment, the inlet mouth 150 is formed in the base 50, preferably it is formed in the first wall 60, i.e. it is formed in the inner surface 65 of the first wall 60.

However, it is not excluded that in alternative embodiments, the inlet mouth 150 and the outlet mouth 155 may both be formed in the base 50 or in the head 90.

The inlet mouth 150 is configured to suction a mixture flow with direction parallel to the rotation axis R.

In other words, the inlet mouth 150 has a central axis substantially parallel to the rotation axis R.

Furthermore, the inlet mouth 150 is crossed by a center plane of the engine 1 perpendicular to a center plane which passes through the outlet mouth 135 of the suction duct 125. The outlet mouth 155 is formed in a portion of the cylindrical cavity 95 and for example is entirely at a greater distance from the bottom dead center than the outlet mouth 135 of the suction duct 125 e. These outlet mouths 135, 155 have an extension along the axis of the cylindrical cavity 40 such that they never communicate directly.

The transfer duct 145 is internally empty, from the inlet mouth 150 to the outlet mouth 155.

That is, inside the transfer duct 145 there are no devices configured to regulate a flow of fluid, or mixture, coming from the pumping chamber 105 and directed to the combustion chamber 110 which passes through the transfer duct 145 and there are no devices configured to add or subtract fluid to said flow.

By way of a non-limiting example, it is possible to indicate that in the transfer duct 145 there are no devices for regulating the flow of mixture coming from the pumping chamber 105 and directed to the combustion chamber 110 which passes through the transfer duct 145, there are no addition devices of mixture to said mixture flow, there are no addition devices of air alone to said mixture flow, there are no subtraction devices of mixture to said mixture flow.

The engine 1 comprises an exhaust duct 160 provided with an inlet mouth 165 adapted to be placed in fluid communication with the combustion chamber 110, for example formed in a portion of the cylindrical cavity 95, preferably in a position opposite to the outlet mouth of the suction duct 125.

The inlet mouth 165 of the exhaust duct 160 is entirely positioned at a distance from the bottom dead center greater than the outlet mouth 135 of the suction duct 125. In this way, the exhaust duct 160 and the suction duct 125 never communicate with each other.

The inlet mouth 165 of the exhaust duct 160 is located at a distance from the bottom dead center which is superposable to the distance from the bottom dead center of the outlet mouth 155 of the transfer duct 145.

Therefore, the inlet mouth 165 and the outlet mouth 155 are adapted to be placed at least partially in fluid communication with each other by the combustion chamber 110.

Moreover, the distance between one end of the inlet mouth 165 of the exhaust duct 160 distal from the bottom dead center and the bottom dead center is greater than the distance between one end of the outlet mouth 155 of the transfer duct 145 distal from the bottom dead center and the bottom dead center.

The engine 1, through the movement of the piston between the bottom dead center and the top dead center, implements (during a single 360° rotation of the crank shaft 10 with respect to the rotation axis R) the following steps described below.

Starting from a position in which the piston 40 is at the top dead center and occludes the outlet mouth 155 of the transfer duct 145 and the inlet mouth 165 of the exhaust duct 160, the engine 1 performs an expansion step in which the piston 40 moves from the top dead center to the bottom dead center and during which it keeps the outlet mouth 155 of the transfer duct 145 and the inlet mouth of the exhaust duct 160 completely occluded.

In this step, the outlet mouth 135 of the suction duct 125, which is completely in fluid communication with the pumping chamber 105 when the piston is at the top dead center, is progressively occluded between the beginning and the end of said expansion step.

Furthermore, in this step, the combustion of the mixture present in the combustion chamber moves the piston 40 from the top dead center to the bottom dead center.

Thereafter, the engine 1 performs a spontaneous exhaust step in which the piston 40 moves towards the bottom dead center and during which it partially releases the inlet mouth 165 of the exhaust duct 160 and keeps the outlet mouth 155 of the transfer duct 145 occluded.

During the spontaneous exhaust step, the outlet mouth 135 of the suction duct 125 is occluded by the piston 40.

Thereafter, the engine 1 performs an operating step during which the piston 40 reaches the bottom dead center and then goes back towards the top dead center, in which the outlet mouth 155 of the transfer duct 145 and the inlet mouth 165 of the exhaust duct 160 are simultaneously in fluid communication with the combustion chamber 110.

Next, the engine 1 performs a forced exhaust step, in which the piston 40 continues to move from the bottom dead center to the top dead center and while keeping the outlet mouth 155 of the transfer duct 145 closed, it progressively completely occludes the inlet mouth 165 of the exhaust duct 160.

During this step, the piston 40 partially places the outlet mouth 135 of the suction duct 125 in fluid communication with the pumping chamber 105.

Thereafter, the engine 1 performs a compression step, during which the piston reaches the top dead center and in which the outlet mouth of the transfer duct 145 and the inlet mouth 165 of the exhaust duct 160 are enclosed by the piston 40.

During the compression step, the outlet mouth 135 of the suction pipe 125 remains in fluid communication with the pumping chamber 105.

The engine 1 comprises the movable partition, housed inside the pumping chamber 105, for example entirely housed in the pumping chamber 105 and operatively connected to the crank shaft 10 to occlude the inlet mouth 150 of the transfer duct 145 during a first portion of the operating step, and to put in fluid communication the inlet mouth 150 of the transfer duct 145 with the pumping chamber 105 (at least) during a second portion of the operating step.

The first portion of the operating step is immediately following the end of the spontaneous discharge step. That is, the first portion of the operating step begins when the piston 40 starts to free the outlet mouth 155 of the transfer duct 145 from its own occlusion.

The end of the first portion of the operating step may be made between 30° of crank, or rotation of the crank shaft with respect to the rotation axis R, before the bottom center and 30° of the crank after the bottom dead center.

In the illustrated embodiment, the end of the first portion of the operating step is achieved after the piston 40 has reached the bottom dead center.

That is, in the illustrated embodiment, the end of the first portion of the operating step may be made between 0.01 and 30 degrees of a crank after the bottom dead center.

The second portion of the operating step is for example immediately following the first portion of the operating step.

The second portion of the operating step lasts at least until the end of the operating step itself.

For example, the operating step of the engine 1 is partially overlapped with the forced exhaust step and the second portion of said operating step ends after the start of the forced exhaust step.

The movable partition is preferably fixed to the crank shaft 10 and is driven in rotation directly thereby with respect to the rotation axis R, for example it is directly fixed to the first cylindrical section 15 of the crank shaft 10 and is driven in rotation thereby with respect to the rotation axis R.

In the illustrated embodiment, the movable partition comprises a disc-shaped body 170 directly fixed to the crank shaft 10 and directly driven in rotation thereby with respect to the rotation axis R, for example directly fixed to the first cylindrical section 15 of the crank shaft 10 and directly driven in rotation thereby with respect to the rotation axis R.

The disc-shaped body 170 has an angular extension with respect to the rotation axis R such as to occlude the inlet mouth 150 of the transfer duct 145 at least during the first portion of the operating step.

Preferably, the disc-shaped body 170 has an angular extension of 360° with respect to the rotation axis R. That is, the disc-shaped body 170 is shaped like a circle.

The disc-shaped body 170 is interposed between the base 50, or between the first wall 60 of the base 50, and the crank 25 of the crank shaft.

The disc-shaped body 170 has a surface 175 facing the first wall 60, which is conjugated to the shape of the first wall itself, for example is conjugated to the shape of the inner surface 65 of the first wall 60.

That is, the surface 175 of the disc-shaped body 170 facing the first wall 60 lies on a plane perpendicular to the rotation axis R.

Between the disc-shaped body 170 and the first wall 60 an interspace is included, for example which has a medium thickness (to be understood as a distance between the disc-shaped body and the first wall) not zero, preferably less than 1 mm.

The disc-shaped body 170 has an extension in the radial direction substantially equal by default to the distance between the rotation axis R and the side wall 80. In practice, between a peripheral edge of the disc-shaped body 170 and the curved surface 85 of the side wall 80 there is a gap which has a thickness (to be understood as a distance between the disc-shaped body and the curved surface) not less than 1 mm.

The movable partition comprises a through slot 180 formed in the disc-shaped body 170 in such a position as to place in fluid communication the inlet mouth 150 of the transfer duct 145 with the pumping chamber 105 during the second portion of the operating step.

The through slot 180 has an extension, measured along an axis perpendicular to the rotation axis R, at least equal to the maximum extension, measured along an axis perpendicular to the rotation axis R, of the inlet mouth 150 of the transfer duct 145.

The through slot 180 extends angularly with respect to the rotation axis R by an angle equal to the crank angle of duration of the second portion of the operating step.

In the illustrated embodiment, the through slot 180 extends from the periphery of the disc-shaped body 170 to the rotation axis R.

The movable partition comprises an annular sealing body 185 extending from the radial periphery of the disc-shaped body 170 in the opposite direction to the inlet mouth 150 of the transfer duct 145, or in the opposite direction to the first wall 60. Or, it extends towards the crank 25.

The annular body 185 forms a closed ring, for example thin. That is, wherein its extension in the radial direction with respect to the rotation axis R is much smaller than its extension in a direction parallel to the rotation axis R.

Said annular body 185 extends in said opposite direction with respect to the inlet mouth 150 by a length substantially equal to the extension, in the direction of the rotation axis R, of an arm of the crank 25.

Or in other words, a length between 0.05 and 0.5 times the radius of the disc-shaped body 170.

Such an annular body 185 has a surface 190 facing the side wall 80 of the base and conjugated to the curved surface 85 of said side wall 85.

That is, the annular body is shaped like an axially hollow cylinder.

Between the annular body 185 and the side wall, or the curved surface 85 of the side wall 80, there is a gap having a thickness (to be understood as a distance between the annular body and the curved surface), not zero, for example less than 1 mm.

Figure 4:
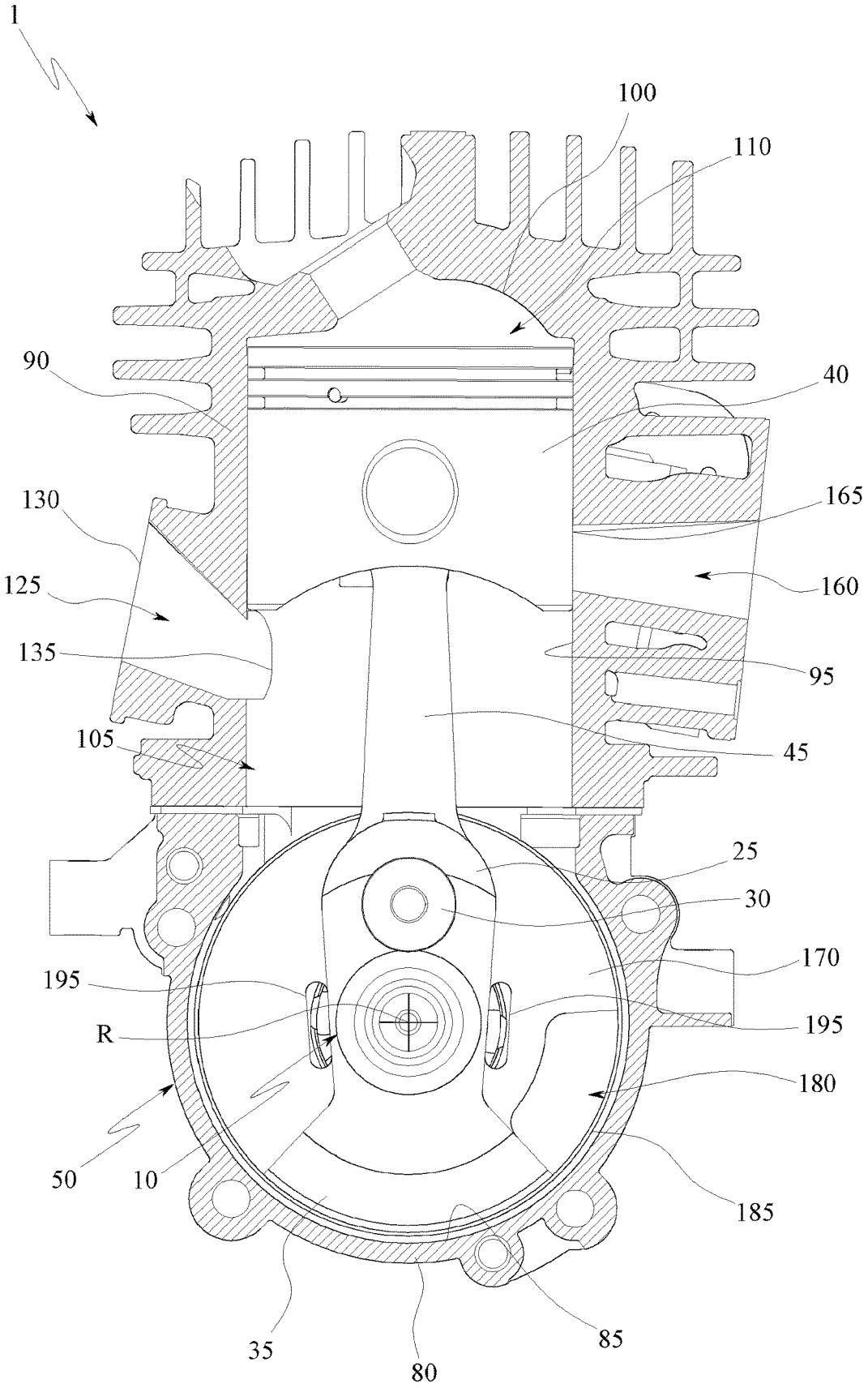
FIG. 4 is a partial section of FIG. 1 according to a center line plane of the engine perpendicular to a rotation axis of a crank shaft of the engine itself, in which the piston is at the top dead center.
Figure 5:
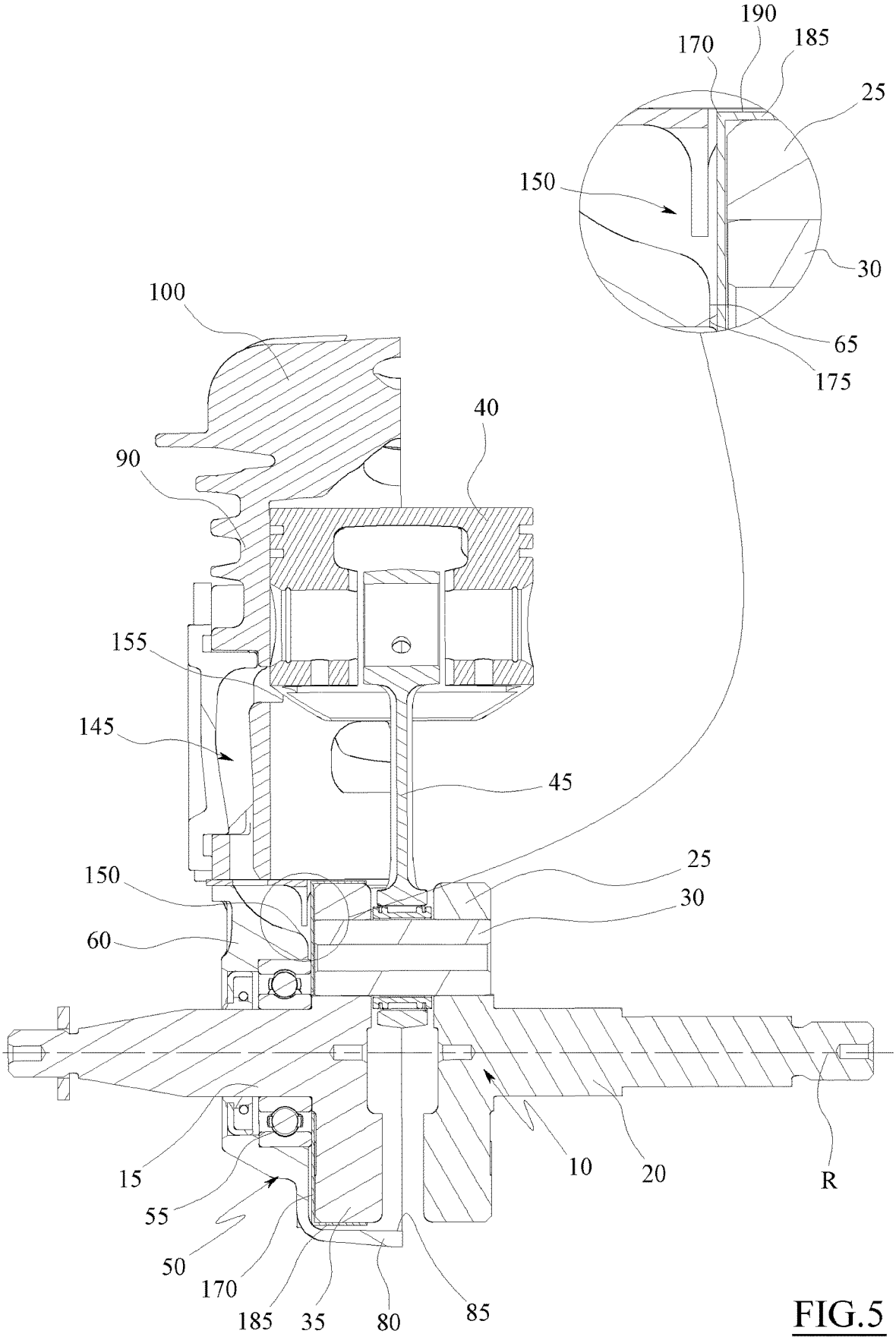
FIG. 5 is a partial section of FIG. 4 according to a center line plane of the engine containing the rotation axis of the crank shaft, in which the piston is at the top dead center.
Figure 6:
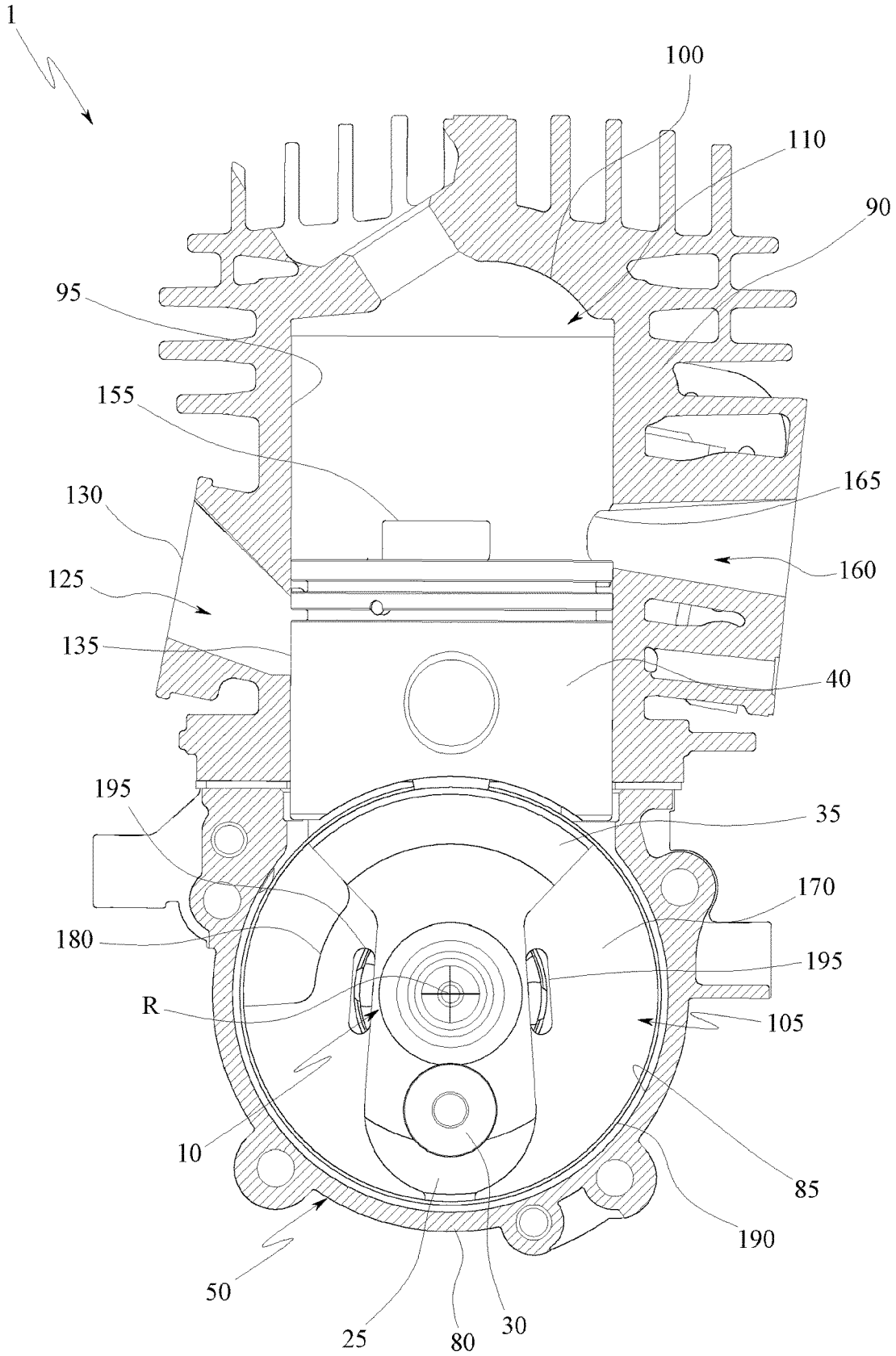
FIG. 6 is a partial section of FIG. 1 according to the center line plane of the engine perpendicular to the rotation axis of the crank shaft of the engine itself, in which the piston is at the bottom dead center.
Figure 7:
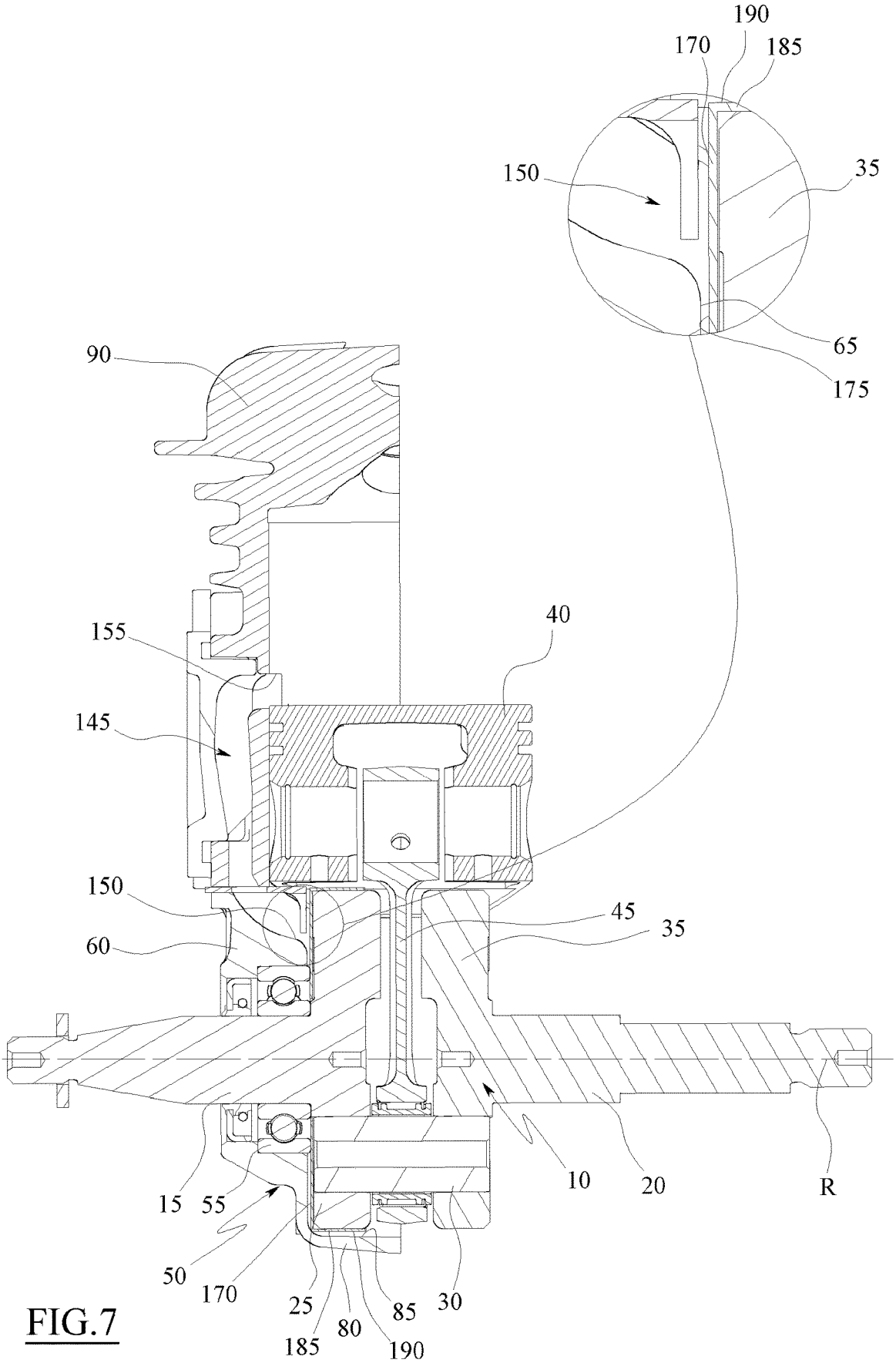
FIG. 7 is a partial section of FIG. 6 according to the center line plane of the engine containing the rotation axis of the crank shaft, in which the piston is at the bottom dead center.

With particular reference to FIGS. 4 and 6, the movable partition comprises a further through slot 195 formed in a portion of the disc-shaped body 170 proximal to the crank shaft portion 10 to which the disc-shaped body is fixed.

For example, such a through slot 195 is formed at a distance from the rotation axis R substantially equal to the distance of the bearings 55 from the rotation axis R.

The further through slot 195 is shaped and positioned such that during rotation of the disc-shaped body 170 driven by the crank shaft 10 it never puts the inlet mouth 150 in communication with the pumping chamber 105.

In practice, the further through slot 195 has a maximum distance, in a radial direction with respect to the rotation axis R, from the rotation axis R lower than the minimum distance, along the same direction, of the inlet mouth 150 from the rotation axis R.

Preferably, the movable partition comprises a pair of through slots 195 diametrically opposite to the rotation axis R.

In an embodiment not shown, the movable partition comprises a disc-shaped body which extends angularly with respect to the rotation axis R only by an angle equal to the crank angle of duration of the first portion of the operating step. In this embodiment, the disc-shaped body is free of through slots.

In an embodiment not shown, the movable partition is made as a single body with the crank shaft 10.

For example, the disc-shaped body 170 may be made as a single body, that is, as a monolithic body, with the crank 25 or with the flywheel mass or as a single body with both. The engine 1 may comprise a further transfer duct (not shown in the drawings), adapted to place the pumping chamber 105 and the combustion chamber 110 in fluid communication.

The further transfer duct is opposed to the transfer duct with respect to the central axis of the cylindrical cavity and is, for example, shaped as the transfer duct described above.

In particular, the further transfer duct comprises an inlet mouth made in the second wall, or in the inner surface 65 of the second wall, preferably in a substantially opposite position to the inlet mouth 150 of the transfer duct 145.

The transfer and further transfer may, for example, be split, or be each formed by a pair of flanked channels.

The described engine steps also apply to this embodiment in which the further transfer duct is present, since in this case the outlet mouth of the transfer ducts and the inlet mouth of the transfer ducts are located respectively at the same distances from the bottom dead center and have substantially the same dimensions.

In this embodiment, the engine 1 comprises a further movable partition housed inside the pumping chamber 105 and operatively connected to the motor shaft to occlude the inlet mouth of the transfer duct during the first portion of said operating step, and to put in fluid communication the inlet mouth of the transfer duct with the pumping chamber during the second portion of the operating step The further movable partition comprises a disc-shaped body interposed between the crank 25 and the second wall, between which there is, for example, a gap of a non-zero size.

Unlike the reciprocal positioning with respect to the second wall 70, for the other features, the further partition is similar and specular to the movable partition.

The operation of the engine 1 described above is as follows.

When the piston 40 moves from the top dead center to the bottom dead center due to the combustion of the fresh mixture previously present in the combustion chamber, it first frees the inlet mouth 165 of the exhaust duct 160 and then the outlet mouth 155 of the transfer duct 145.

Up to at least the bottom dead center, the through slot 180 of the movable partition is not aligned with the inlet mouth 150 of the transfer duct 145, consequently the disc blocks the entrance to the transfer duct by the fresh mixture present in the pumping chamber 105, during the first portion of the operating step.

Subsequently, the disc-shaped body, continuing to rotate with the crank shaft 10, carries the through slot 180 in a position aligned with the inlet mouth 150 of the transfer duct 145, allowing the entry of fresh mixture into the combustion chamber.

The piston then proceeds in its run towards the bottom dead center, compressing the fresh mixture entered into the combustion chamber during the second portion of the operating step.

The invention thus conceived is susceptible to numerous modifications and variations, all of which are within the scope of the inventive concept.

Moreover, all details can be replaced with other technically equivalent elements.

In practice, the materials used as well as the shapes and sizes may be any according to the requirements, without departing from the protection scope of the following claims.

The invention claimed is:

1. A two-stroke internal combustion engine (1) comprising:

a base (50), a head (90) fixed to the base (50) and in which a cylindrical cavity (95) is formed, a piston (40) slidably received in the cylindrical cavity (95), so as to define a combustion chamber (110) and a pumping chamber (105), and movable in the cylindrical cavity (95) between a bottom dead center, in which the volume of the combustion chamber (110) is maximum and the volume of the pumping chamber (105) is minimum, and a top dead center, in which the volume of the combustion chamber (110) is minimum and the volume of the pumping chamber (105) is maximum, a transfer duct (145) provided with an inlet mouth (150) adapted to be placed in fluid communication with the pumping chamber (105), and with an outlet mouth (155) adapted to be placed in fluid communication with the combustion chamber (110), an exhaust duct (160) provided with an inlet mouth (165) adapted to be placed in fluid communication with the combustion chamber (110), a crankshaft (10) at least partially housed in the pumping chamber (105), a connecting rod (45) adapted to connect the piston (40) to said crankshaft (10), wherein the two-stroke internal combustion engine (1) implements, by means of the movement of the piston (40) between the top dead center and the bottom dead center, an operating step during which the inlet mouth (165) of the exhaust duct (160) and the outlet mouth (155) of the transfer duct (145) are simultaneously in fluid communication with the combustion chamber (110), wherein said two-stroke internal combustion engine (1) comprises a movable partition housed inside the pumping chamber (105), fixed to the crankshaft (10) and driven in rotation thereby with respect to a rotation axis (R) of the crankshaft itself to occlude the inlet mouth (150) of the transfer duct (145) during a first portion of said operating step, and to put in fluid communication the inlet mouth (150) of the transfer duct (145) with the pumping chamber (105) during a second portion of the operating step, wherein the movable partition comprises:

a disc-shaped body (170), which is rigidly integral in rotation to the crankshaft (10) and is positioned so as to occlude the inlet mouth (150) of the transfer duct (145) at least during the first portion of the operating step, and a through slot (180) formed in the disc-shaped body (170) and positioned in such a way as to place in fluid communication the inlet mouth (150) of the transfer duct (145) with the pumping chamber (105) during the second portion of the operating step, wherein the disc-shaped body (170) is interposed between a crank (25) of the crankshaft (10) and the base (50), wherein the movable partition comprises an annular sealing body (185) extending from a radial periphery of the disc-shaped body (170) in the opposite direction with respect to the inlet mouth (150) of the transfer duct (145), and wherein the movable partition comprises a further through slot (195) made in the disc-shaped body (170), in a portion of the disc-shaped body (170) itself proximal to the crankshaft (10) and at a distance from the rotation axis (R) substantially equal to the distance of the bearings (55) from the rotation axis (R).

2. The two-stroke internal combustion engine (1) according to claim 1, wherein the annular body (185) forms a closed ring.

3. The two-stroke internal combustion engine (1) according to claim 1, wherein the annular body (185) is shaped like an axially hollow cylinder.

4. The two-stroke internal combustion engine (1) according to claim 1, wherein the annular body (185) extends in said opposite direction with respect to the inlet mouth (150) by a length between 0.05 and 0.5 times a radius of the disc-shaped body (170).

5. A two-stroke internal combustion engine (1) comprising:

a base (50) with a seat for receiving a crank shaft (10), such a crank shaft (10) is rotatably associated with the base with respect to a rotation axis (R) and comprises a first cylindrical section (15) coaxial to the rotation axis (R), a second cylindrical section (20) opposed to the first cylindrical section (15) and coaxial to the rotation axis (R), and a crank (25) which connects the first cylindrical section (15) and the second cylindrical section (20) and is rigidly integral in rotation thereto, and wherein the crank shaft (10) is rotatably associated to the base by interposing a pair of bearings (55), of which one is coupled to the first cylindrical section (15) and the other is coupled to the second cylindrical section (20), a head (90) fixed to the base (50) and in which a cylindrical cavity (95) is formed, a piston (40) slidably received in the cylindrical cavity (95), so as to define a combustion chamber (110) and a pumping chamber (105), and movable in the cylindrical cavity (95) between a bottom dead center, in which the volume of the combustion chamber (110) is maximum and the volume of the pumping chamber (105) is minimum, and a top dead center, in which the volume of the combustion chamber (110) is minimum and the volume of the pumping chamber (105) is maximum, a transfer duct (145) provided with an inlet mouth (150) adapted to be placed in fluid communication with the pumping chamber (105), and with an outlet mouth (155) adapted to be placed in fluid communication with the combustion chamber (110), an exhaust duct (160) provided with an inlet mouth (165) adapted to be placed in fluid communication with the combustion chamber (110), a connecting rod (45) adapted to connect the piston (40) to said crank shaft (10), wherein the two-stroke internal combustion engine (1) implements, by means of the movement of the piston (40) between the top dead center and the bottom dead center, an operating step during which the inlet mouth (165) of the exhaust duct (160) and the outlet mouth (155) of the transfer duct (145) are simultaneously in fluid communication with the pumping combustion chamber (105,110), a movable partition housed inside the pumping chamber (105) and operatively connected to the crank shaft (10) to occlude the inlet mouth (150) of the transfer duct (145) during a first portion of said operating step, and to put in fluid communication the inlet mouth (150) of the transfer duct (145) with the pumping chamber (105) during a second portion of the operating step, wherein the end of the first portion of the operating step is between 30° of rotation of the crank shaft (10) before the bottom dead center and 30° of rotation of the crank shaft (10) after the bottom dead center, wherein the movable partition comprises:

a disc-shaped body (170), which is rigidly integral in rotation to the crank shaft (10) and is positioned so as to occlude the inlet mouth (150) of the transfer duct (145) at least during the first portion of the operating step;

a through slot (180) formed in the disc-shaped body (170) and positioned in such a way as to place in fluid communication the inlet mouth (150) of the transfer duct (145) with the pumping chamber (105) during the second portion of the operating step; and a further through slot (195) made in the disc-shaped body (170), in a portion of the disc-shaped body (170) proximal to the crank shaft (10) and at a distance from the rotation axis (R) substantially equal to the distance of the bearings (55) from the rotation axis (R).

* * * * *